US006024174A

United States Patent [19]

Pierce

[11] Patent Number: 6,024,174

[45] Date of Patent: Feb. 15, 2000

[54] SPRINKLER HEAD AND A TEMPERATURE CONTROLLED VALVE THEREFOR

[76] Inventor: Lauvon Pierce, Rte. 1, Box 122, Leakesville, Miss. 39451

[21] Appl. No.: 08/990,188

[22] Filed: Dec. 12, 1997

[51] Int. Cl.[7] ..... A62C 37/08

[52] U.S. Cl. ..... 169/37; 251/325

[58] Field of Search ..... 169/38, 37, 39, 169/40, 41; 251/324, 325, 282

[56] References Cited

U.S. PATENT DOCUMENTS

| | | | |
|---|---|---|---|
| Re. 29,155 | 3/1977 | Mears et al. . | |
| 2,713,989 | 7/1955 | Bryant | 251/324 X |
| 2,880,958 | 4/1959 | Monica | 281/324 X |
| 2,933,285 | 4/1960 | Tucker | 251/324 |
| 2,995,337 | 8/1961 | Tanna | 251/324 X |
| 3,423,064 | 1/1969 | Harland et al. | 251/324 X |
| 3,734,191 | 5/1973 | Johnson et al. . | |
| 4,899,825 | 2/1990 | Bosoni et al. . | |
| 5,183,116 | 2/1993 | Fleming . | |
| 5,441,113 | 8/1995 | Pierce . | |
| 5,513,708 | 5/1996 | Sundholm | 169/38 X |

*Primary Examiner*—Kevin Weldon
*Attorney, Agent, or Firm*—Richard C. Litman

[57] ABSTRACT

A temperature sensitive valve, and two embodiments of a sprinkler head operated by the valve. A sprinkler head core houses the temperature sensitive valve and has a supply conduit entering through the top surface of the head core. The first embodiment of the sprinkler head has a dispensing conduit extending through the side wall of the core. The dispensing conduit supplies fire fighting material to a ring with a plurality of radially spaced nozzles. A casing surrounds the core and supports the ring. The preferred embodiment of the sprinkler head has a plurality of fire fighting material dispensing ports that are radially and equidistantly arranged around the side wall of the core, thereby allowing fire fighting material to be dispensed in a 360° pattern without the need for external conduits. The first embodiment of the core may also be used as a drip valve to prevent freeze damage in fire extinguishing or other fluid systems. In either embodiment, the valve of the present invention is within a cylindrical cavity inside the core of the sprinkler head. The cavity includes a large diameter top section and a small diameter bottom section, with a valve piston slidably mounted therein. The piston includes a main piston body, a top sealing disc that provides the valving action, and a bottom sealing disc that maintains alignment between the piston and the cavity. An ambient temperature sensor within the cavity, is operatively attached to the piston via an activating rod.

5 Claims, 3 Drawing Sheets

SPRINKLER HEAD AND A TEMPERATURE CONTROLLED VALVE THEREFOR

BACKGROUND OF THE INVENTION

1. Field of the Invention

The present invention relates to fire extinguishing sprinkler heads and a temperature controlled valve specifically designed for use in sprinkler heads.

2. Description of the Related Art

Many fire extinguishing systems that dispense water and/or fire fighting foams, use sprinkler heads to deliver the fire fighting material. The sprinkler heads often contain a temperature sensitive actuator that opens a valve within the sprinkler head when the temperature sensed exceeds a predetermined set-point. The present invention provides a simple but effective valve for these types of sprinkler heads.

U.S. Pat. No. 3,734,191, issued on May 22, 1973 to Johnson, et al., shows a temperature controlled sprinkler head assembly having a spring biased closure. A temperature sensitive actuator controls a simple valve within the sprinkler head. U.S. Pat. No. Re. 29,155 issued on Mar. 22, 1977 to Mears et al., discloses an on-off sprinkler with a valve controlled by a bimetal disc actuator. The actuator has a snap action and hysteresis for providing a thermal delay upon closing the valve. U.S. Pat. No. 4,899,825, issued on Feb. 13, 1990 to Bosoni, et al., describes a fire extinguishing system wherein a foam-water mixture is supplied via a single conduit to a user device. Volumetric pumps proportionally meter fire fighting foam based on the flow of fire fighting water. U.S. Pat. No. 5,183,116, issued on Feb. 2, 1993 to Fleming shows a variable pressure regulator that controls the flow rate of fire extinguishing material to a discharge nozzle. A pressure sensitive valve includes a piston body with an O-ring seal that regulates the flow of the fire extinguishing material based on the pressure of the material.

The most pertinent related art device is disclosed in U.S. Pat. No. 5,441,113, issued on Aug. 15, 1995 to Pierce, (the present inventor) and this patent is hereby incorporated by reference. The fire extinguishing system described in this patent uses a sprinkler head having a shuttle valve that is operated by a bimetallic disc. The present invention improves upon this sprinkler head by using a valve having a simpler and more effective sealing arrangement. In addition, a second embodiment of the sprinkler head of the present invention eliminates much of the structure needed in the prior art device, and is therefore less expensive to manufacture.

None of the above inventions and patents, taken either singularly or in combination, is seen to describe the instant invention as claimed. Thus a sprinkler head solving the aforementioned problems is desired.

SUMMARY OF THE INVENTION

The present invention is directed to a temperature sensitive valve, and two embodiments of a sprinkler head operated by the valve. A sprinkler head core houses the temperature sensitive valve of the present invention and has a fire fighting material supply conduit entering through the top surface thereof. It should be noted that the term "fire fighting material" is intended to include water, fire fighting foam, and any other fire fighting material that flows and can be controlled by valving arrangements. The sprinkler head is attached to a ceiling (or other overhead structure) by a mounting bracket. The side wall of the core of a first embodiment of the sprinkler head has a dispensing conduit extending therethrough that supplies fire fighting material to a ring with a plurality of radially spaced nozzles. An optional casing surrounds the core and provides additional support for the ring.

Within the core is a cylindrical cavity that includes a large diameter top section and a small diameter bottom section. The supply conduit is in fluid communication with the large diameter top section, while the dispensing conduit is in fluid communication with the small diameter bottom section. A piston is slidably mounted within the cavity and includes a main piston body, a top sealing disc and a bottom sealing disc. The sealing discs both have an external diameter substantially equal to the internal diameter of the small diameter bottom section of the cavity. O-ring seals extend around both the top sealing disc and the bottom sealing disc. The top sealing disc provides the valving action, while the bottom sealing disc provides a seal between the fluid flow path and the ambient temperature sensor and also helps to maintain coaxial alignment between the piston and the cavity.

An ambient temperature sensor is located within the cavity close to the bottom surface of the core. In the preferred embodiment, the ambient temperature sensor is a bimetallic disc, although any type of heat motor may be used. The bimetallic disc includes a central aperture with a screw that attaches the bimetallic disc to one end of an activating rod. The other end of the activating rod is attached to the valve. As long as the ambient temperature is below a predetermined activation temperature the valve is held in the closed position. When the ambient temperature rises above the predetermined activation temperature the valve is held in the open position. Two ridges are positioned above and below the bimetallic disc, to maintain the position of the bimetallic disc within the small diameter bottom section. A spring located in the large diameter section of the cylindrical cavity biases the piston to the closed position.

The preferred embodiment of the sprinkler head is similar in operation to the first embodiment, however the casing, dispensing conduit and ring are eliminated. A plurality of fire fighting material dispensing ports are radially and equidistantly arranged around the small diameter bottom section of the cavity and extend directly through the core sidewall. This arrangement allows fire fighting material to be dispensed in a predetermined, usually 360° pattern, without the need for external conduits.

The first embodiment of the core may also be used as a drip valve to prevent freeze damage in fire extinguishing or other fluid systems. When used as a drip valve, the supply conduit is placed in fluid communication with the system to be protected. The dispensing conduit is routed to a point where fluid exiting the system will not cause damage. The bimetallic disc is constructed of materials such that as long as the ambient temperature is above a drip valve activation temperature (close to freezing) the valve is held closed. When the ambient temperature falls below the drip valve activation temperature, the valve is held open to allow a small amount of fluid to flow, thereby preventing freezing of the fluid.

Accordingly, it is a principal object of the invention to provide a sprinkler head valve having an improved seal and smoother operation.

It is another object of the invention to provide an effective 360° sprinkler head with a reduced number of parts.

It is a further object of the invention to provide a drip valve having an improved seal and smoother operation.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
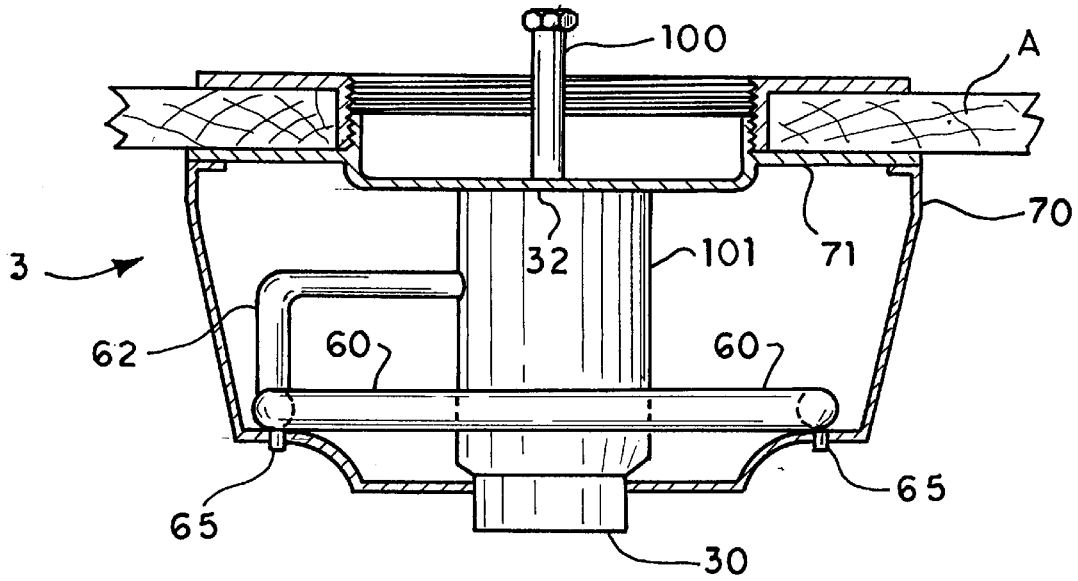
FIG. 1 is a detail view, partly in cross section, of a first embodiment of a sprinkler head having a casing and the sprinkler head valve of the present invention.

The present invention is directed to a temperature sensitive valve, and a sprinkler head utilizing this valve. FIG. 1 illustrates a sprinkler head 3, having a sprinkler head core 30, that houses the temperature sensitive valve of the present invention. A fire fighting material supply conduit 100 extends through the top surface 32 of the core 30 and is connected to a fire fighting material supply (not shown). The fire fighting material supply may be a water source or a closed system having a water or fire fighting foam reservoir. The top surface 32 of the core 30 is attached to a ceiling (or other structure) A using a mounting bracket 71. The core 30 includes a cylindrical, vertical, core sidewall 101 that has a dispensing conduit 62 extending therethrough. Dispensing conduit 62 supplies fire fighting material to ring 60, which includes a plurality of radially spaced nozzles 65. The nozzles 65 are shown pointing downward, however, they may be directed outwardly to increase the area the fire fighting material is dispensed. An optional casing 70 surrounds the core 30 and provides additional support for the ring 60.

Figure 2:
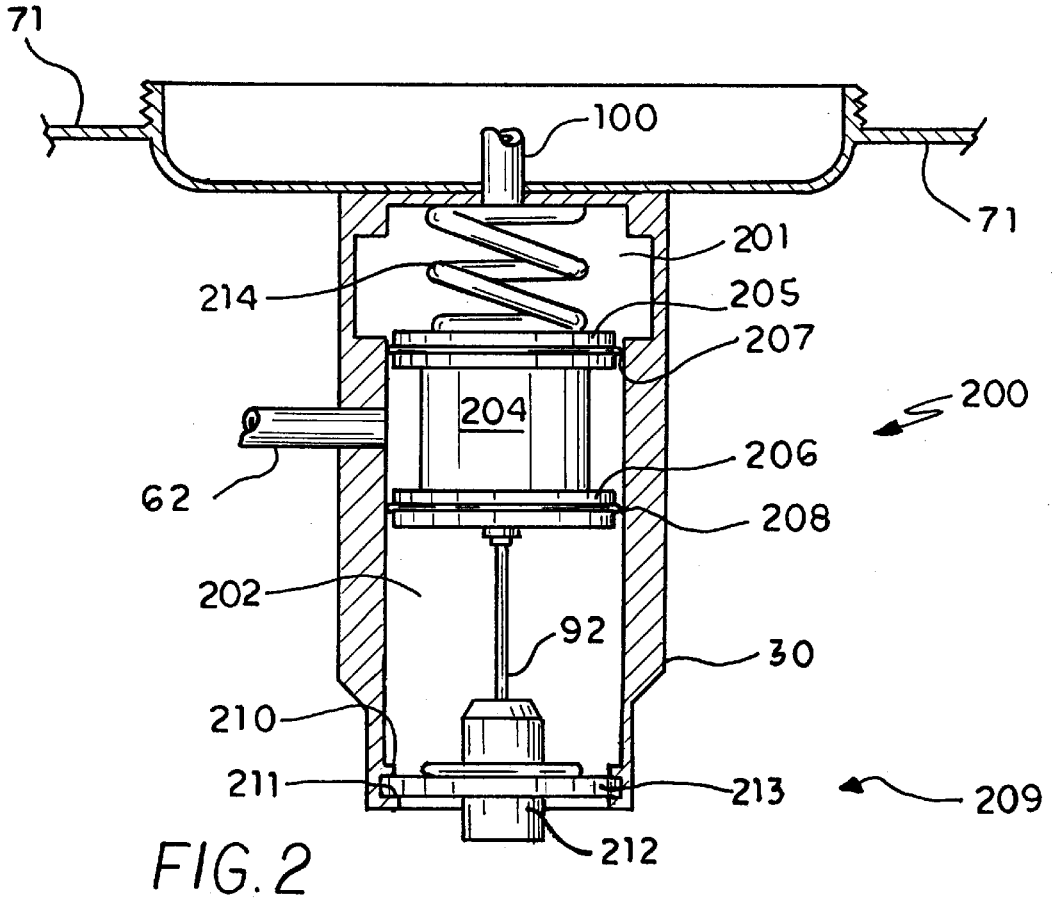
FIG. 2 is a detail view, partly in cross section, of the sprinkler head core of FIG. 1, with the casing removed.
Figure 3:
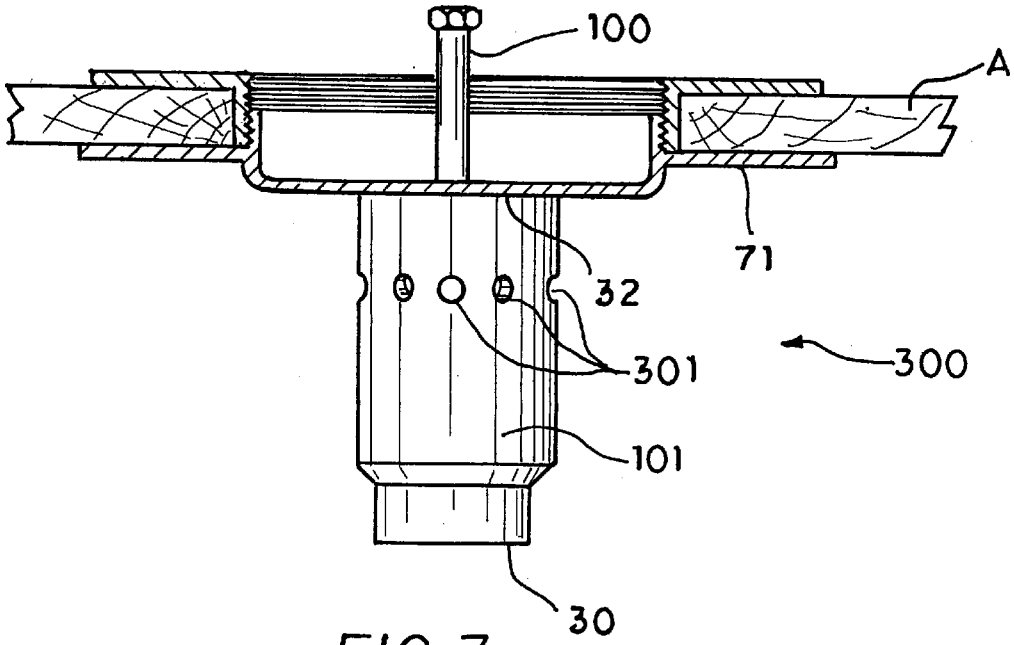
FIG. 3 is a detail view, partly in cross section, of a second embodiment of a sprinkler head having the sprinkler head valve of the present invention.

FIG. 2 shows the details of the valve 200 within core 30. The valve 200 has a cylindrical cavity that is divided into a large diameter top section 201 and a small diameter bottom section 202. The fire fighting material supply conduit 100 is in fluid communication with the large diameter top section 201 of the cavity, while the dispensing conduit 62 is in fluid communication with the small diameter bottom section 202 of the cavity via dispensing port 203.

Figure 5:
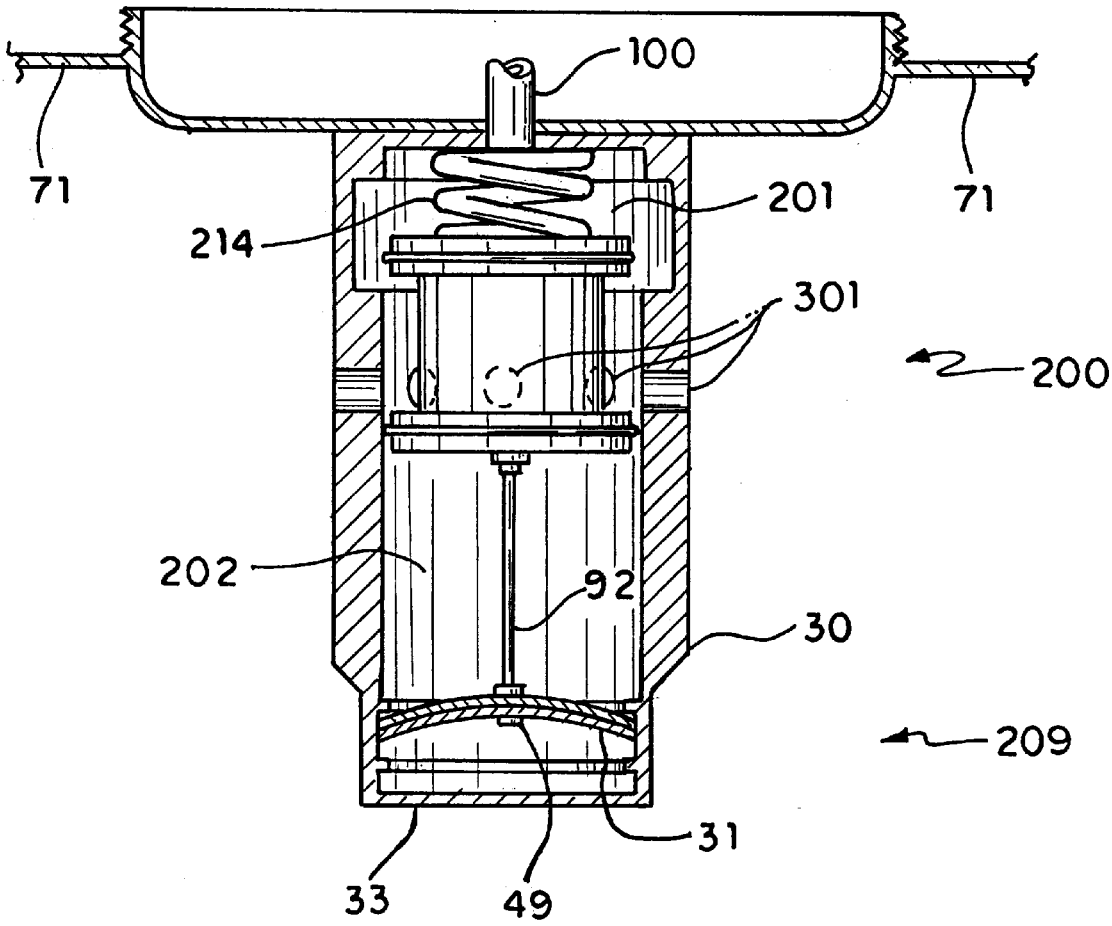
FIG. 5 is a detail view, partly in cross section, of the sprinkler head of FIG. 3, with the sprinkler head valve in an open position.
Figure 6:
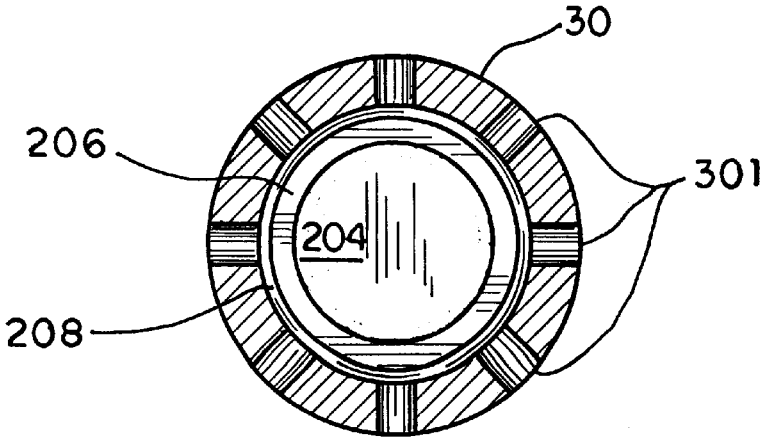
FIG. 6 is a cross sectional view of the second embodiment of the sprinkler head taken through line 6—6 in FIG. 4.

A piston is slidably mounted within the cavity and includes a main piston body 204, a top sealing disc 205 and a bottom sealing disc 206. The top sealing disc 205 and the bottom sealing disc 206 both have an external diameter substantially equal to the internal diameter of the small diameter bottom section 202 of the cavity. A first O-ring seal 207 extends around the top sealing disc 205 and contacts the inner surface of the small diameter bottom section 202, when the piston is in a first closed position (as shown in FIG. 2). In this manner, the top sealing disc 205 provides the valving action by: sealing against the inner surface of the small diameter section 202 in the closed position, (FIG. 2); and raising into the large diameter top section 201 to provide a flow path, (FIG. 5). A second O-ring seal 208 extends around the bottom sealing disc 206 and contacts the inner surface of the small diameter bottom section 202 when the piston is in either the first closed position (FIG. 2) or in a second open position, (as shown in FIG. 5 with respect to a second embodiment of the sprinkler head). The bottom sealing disc 206 provides a seal between the fluid flow path and the ambient temperature sensor 209 (discussed below). In addition, because the bottom sealing disc 206 is in constant contact with the inner surface of the small diameter bottom section 202, the bottom sealing disc 206 also helps to maintain the coaxial alignment between the piston and the cavity.

An ambient temperature sensor 209 is located within the cavity close to the bottom surface 33 of the core 30. In the embodiment shown in drawing 2, the ambient temperature sensor 209 is a heat motor 212. The heat motor 212 is held within the cavity by a spring clip 213 between ridges 210 and 211. An activating rod 92 is attached to the heat motor 212 and to the bottom sealing disc 206. As long as the ambient temperature is below a predetermined activation temperature the heat motor 212 is not activated and spring 214 holds the valve 200 in the closed position (FIG. 2). When the ambient temperature rises above the predetermined activation temperature the heat motor 212 is activated, and the piston is forced upwards against the force of spring 214, and the valve 200 is held in the open position (FIG. 5).

Figure 4:
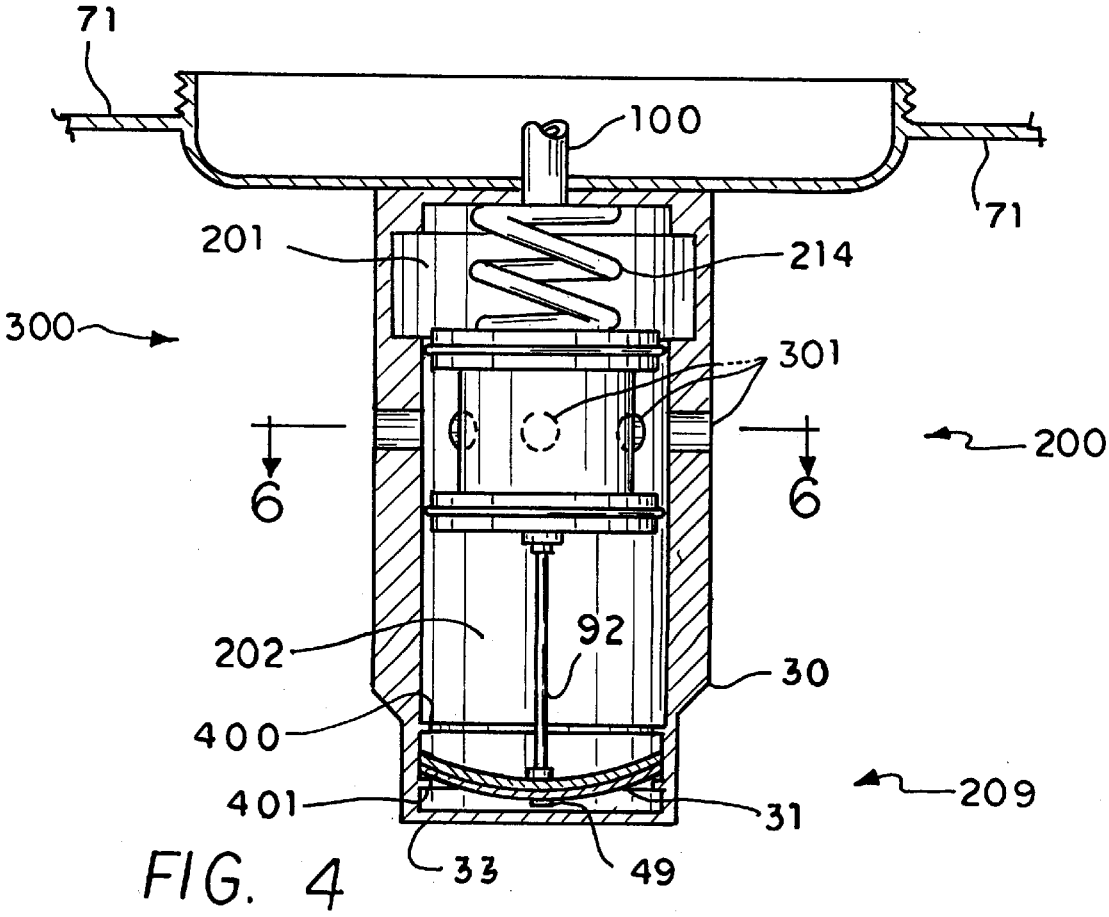
FIG. 4 is a detail view, partly in cross section, of the sprinkler head of FIG. 3, with the sprinkler head valve in a closed position.

FIGS. 4–5 show details of a second embodiment of the ambient temperature sensor 209. In this embodiment the ambient temperature sensor 209, is a bimetallic disc 31. The bimetallic disc 31 includes a central aperture with a screw 49 extending therethrough that attaches the bimetallic disc 31 to one end of an activating rod 92. The other end of the activating rod 92 is attached to the bottom sealing disc 206. As long as the ambient temperature is below a predetermined activation temperature the top surface of the disc 31 is concave and the bottom surface of the disc 31 is convex, and the valve 200 is biased to the closed position by spring 214 (FIG. 4). When the ambient temperature rises above the predetermined activation temperature the top surface of the disc 31 is convex and the bottom surface of the disc 31 is concave, and the valve 200 is held in the open position (FIG. 5) against the force of spring 214. This type of bimetallic material includes a hysteresis such that the deactivation temperature as the ambient temperature falls is lower than the predetermined activation temperature. The small diameter bottom section 202 also includes a first ridge 400 positioned above the bimetallic disc 31 and a second ridge 401 positioned below the bimetallic disc 31. The ridges 400 and 401 contact the outer edge of the bimetallic disc 31 to maintain the position of the bimetallic disc 31 within the small diameter bottom section 202.

The embodiment of the core 30 shown in FIG. 2 may also be used as a drip valve to prevent freeze damage in fire extinguishing or other fluid systems. When used as a drip valve, supply conduit 100 is in fluid communication with the system to be protected. Dispensing conduit 62 is routed outside, or to a point where exiting fluid will not cause damage. The materials used in making the bimetallic disc 31 are selected such that as long as the ambient temperature is above a drip valve activation temperature (close to freezing), the top surface of the disc 31 is concave and the bottom surface of the disc 31 is convex, and the valve 200 is held in the closed position (FIG. 2). When the ambient temperature falls below the drip valve activation temperature, the top surface of the disc 31 is convex and the bottom surface of the disc 31 is concave, and the valve 200 is held in the open position (FIG. 5). The open valve allows fluid to flow, thereby avoiding freeze damage. It should be noted that the drip valve embodiment can be operated by either the heat motor 212 or the bimetallic disc 31.

FIGS. 3–6 show the details of the preferred embodiment of the sprinkler head 300 of the present invention. Similar components in sprinkler head 3 and sprinkler head 300 have been given the same reference designator. In sprinkler head 300, the casing 70, dispensing conduit 62 and ring 60 have been eliminated. A plurality of fire fighting material dispensing ports 301 are radially and equidistantly arranged around the small diameter bottom section 202 of the cavity and extend through the cylindrical, vertical, core sidewall 101. In this way, fire fighting material is dispensed in a predetermined, usually 360° spray pattern, without the need for external conduits. The valve 200 and the ambient temperature sensor 209 in sprinkler head 300 operates as described with respect to sprinkler head 3, above. Sprinkler heads 3 and 300 may be activated by either the heat motor 212 or the bimetallic disc 31.

It is to be understood that the present invention is not limited to the embodiments described above, but encompasses any and all embodiments within the scope of the following claims.

I claim:

1. A sprinkler head for dispensing fire fighting material, said sprinkler head comprising:

a core, said core including a core top surface, a core bottom surface and a vertical core sidewall connecting said core top surface and said core bottom surface thus to define a cylindrical cavity therein, said cylindrical cavity defining a large diameter top section and a small diameter bottom section;

a fire fighting material supply conduit extending through said core top surface and in communication with said large diameter top section of said cavity;

at least one fire fighting material dispensing port extending through said vertical core sidewall and in communication with said small diameter bottom section of said cavity, said at least one fire fighting material dispensing port includes a plurality of fire fighting material dispensing ports radially and equidistantly arranged about said small diameter bottom section of said cavity for dispensing fire fighting material in a predetermined spray pattern;

a piston within said cavity, said piston including a main piston body, a top sealing disc and a bottom sealing disc, said top sealing disc and said bottom sealing disc each having an external diameter substantially equal to said small diameter;

an ambient temperature sensor within said cavity; and an activating rod having a first and a second end, said activating rod first end being attached to said bottom sealing disc, and said second end being attached to said ambient temperature sensor; wherein in a first closed position, said piston top sealing disc is positioned within said small diameter bottom section and thereby seals said large diameter top section from said small diameter bottom section to interrupt flow of fire fighting material from said fire fighting material supply conduit to said at least one fire fighting material dispensing port;

in a second open position said piston top sealing disc is positioned within said large diameter top section and thereby allows flow of fire fighting material from said large diameter top section to said small diameter bottom section and from said fire fighting material supply conduit to said at least one fire fighting material dispensing port;

said ambient temperature sensor biasing said activating rod to move said piston to said first closed position when the ambient temperature is below a predetermined activation temperature; and said ambient temperature sensor biasing said activating rod to move said piston to said second open position when the ambient temperature is above said predetermined activation temperature.

2. The sprinkler head according to claim 1, further comprising:

a first O-ring seal extending around said top sealing disc and contacting an inner surface of said small diameter bottom section when said piston is in said first closed position; and a second O-ring seal extending around said bottom sealing disc and contacting said inner surface of said small diameter bottom section when said piston is in both said first closed position and in said second one position, to thereby assist in maintaining alignment between said piston and said cavity.

3. The sprinkler head according to claim 1, wherein:

said ambient temperature sensor is a bimetallic disc, said bimetallic disc having a top surface and a bottom surface;

said top surface is concave and said bottom surface is convex when the ambient temperature is below said predetermined activation temperature and said piston is in said first closed position; and said top surface is convex and said bottom surface is concave when the ambient temperature is above said predetermined activation temperature and said piston is in said second open position.

4. The sprinkler head according to claim 3, wherein said bimetallic disc further includes a central aperture, there further being a screw extending through said aperture for attaching said bimetallic disc to said activating rod.

5. The sprinkler head according to claim 3, wherein said bimetallic disc further includes an outer edge, and said small diameter bottom section further comprises a first ridge positioned above said bimetallic disc and a second ridge positioned below said bimetallic disc, said first and second ridges contacting said outer edge to maintain the position of said bimetallic disc within said small diameter bottom section.

* * * * *